United States Patent [19]

Greko

[11] Patent Number: 4,909,135

[45] Date of Patent: Mar. 20, 1990

[54] ROOF VENT STRUCTURE FOR PLASTIC MEMBRANE ROOFS

[75] Inventor: John C. Greko, Saginaw, Mich.

[73] Assignee: Duro-Last Roofing, Inc., Saginaw, Mich.

[21] Appl. No.: 317,446

[22] Filed: Mar. 1, 1989

[51] Int. Cl.[4] ..... F24F 7/02

[52] U.S. Cl. ..... 98/42.23; 52/199; 98/78; 98/83; 98/122

[58] Field of Search ..... 52/199; 98/42.23, 78, 98/83, 122

[56] References Cited

U.S. PATENT DOCUMENTS

| | | | |
|---|---|---|---|
| 230,952 | 8/1880 | Mark | 98/83 |
| 1,394,735 | 10/1921 | Jordan | 98/78 X |
| 3,509,811 | 5/1970 | Topp | 98/78 |
| 3,685,426 | 8/1972 | Rosa | 98/83 |
| 4,399,743 | 8/1983 | Izzi, Sr. | 98/122 |
| 4,484,424 | 11/1984 | Logsdon | 52/199 |
| 4,652,321 | 3/1987 | Greko | 285/42 X |

FOREIGN PATENT DOCUMENTS

| | | | |
|---|---|---|---|
| 615327 | 2/1961 | Canada | 52/199 |
| 89339 | 7/1960 | Denmark | 98/122 |
| 2218514 | 11/1972 | Fed. Rep. of Germany | 98/78 |
| 197808 | 8/1978 | France | 98/78 |

*Primary Examiner*—Harold Joyce

*Attorney, Agent, or Firm*—Learman & McCulloch

[57] ABSTRACT

A vent structure for use with plastic membrane roofs has an elongate vertical tube with a base flange to which membrane material may be heat welded. An overhanging tube cap has generally radially extending, vertical, venturi passage-creating fins which converge inwardly and enhance the pull of moisture entrained air from the tube when wind currents blow between the cap and upper end of the tube.

15 Claims, 2 Drawing Sheets

ROOF VENT STRUCTURE FOR PLASTIC MEMBRANE ROOFS

BACKGROUND OF THE INVENTION

The present invention relates generally to roof ventilating devices, and methods of constructing and utilizing them in typical flat, or near flat roofs, of the type used mainly for commercial and industrial buildings.

Such roofs consist of a structural roof deck, normally covered by a vapor barrier on top of which is insulation and an impermeable synthetic plastic roofing membrane of the type disclosed, for instance, in the present assignee's U.S. Pat. No. 4,652,321, wherein the membrane consists of a woven polyester core fabric encased in a thermoplastic, synthetic plastic sheath, which typically may be polyvinyl chloride. With insulation sandwiched between the vapor barrier membrane and the outer roof surface membrane, a water and vapor trap may be created which tends to wet the insulation, which then no longer can provide adequate heat flow resistance, and tends to physically degradate. Water present in the materials from which the roof is constructed, or water entering through the top via leaks, or from below as vapor, are typically the sources of the moisture which tends to collect.

In the past, a variety of breather vents have been proposed to alleviate this problem, as exemplified in the following listed patents:

| | | | |
|---|---|---|---|
| Re.31,549 | Ballard et al | 4,484,424 | Logsdon |
| 3,238,862 | Smith et al | 4,512,243 | Ballard et al |
| 4,184,414 | Jarnot | 4,593,504 | Bonnici et al |
| 4,189,989 | Maze | 4,622,887 | Peterson |
| 4,214,513 | Ballard et al | 4,706,418 | Stewart |
| 4,386,488 | Gibbs | | |

With effective stack venting, such wet roofs can be dried over a period of time, and the present vent structure has been conceived to enhance the elimination of moisture from such roof systems.

As noted in an article entitled VENTING OF FLAT ROOFS, by M. C. Baker and C. P. Hedlin, in the "Canadian Building Digest", U.D.C. 69.024.3: 697.92, on page 176-2, "Two transport mechanisms can be in effect in moving moisture through breather vents: the convective moving of air carrying vapor; and vapor diffusion. In addition, wicking along the insulation fibers may help to move moisture laterally through some types of insulation." The article points out that wind can cause a pressure difference which creates convective air movement, as can stack effect, which can be created if some vents are higher than others. On most flat roofs, however, all vent openings will be at approximately the same level, and there will generally be only small pressure differences from wind.

Diffusion, the second transport mechanism involves the movement of water vapor through the insulation to the outside under a vapor pressure difference. The article notes that stack venting is logical for new roofs, as well as wet roofs, and may well take care of small quantities of construction moisture that would otherwise be trapped in the system, as well as small quantities that might get past the vapor barrier. In addition, such vents tend to relieve vapor pressure generated under a heated roof surface.

SUMMARY OF THE INVENTION

The present invention seeks to speed up the drying process.

It is a principal object of the invention to provide a roof vent structure which more effectively dries both new and existing roofs than prior art structures.

Another object of the invention is to provide a moldable, two-piece plastic vent structure which can be readily assembled on the roof in a manner which permits shipment of the parts separately, and removal and replacement of the hood or cap portion of the vent structure for inspection purposes.

Still another object of the invention is to provide a vent apparatus of sturdy and reliable character, which can be relatively economically and rapidly fabricated of a thermoplastic plastic, rather than metal.

Other objects and advantages of the invention will be pointed out specifically or will become apparent from the following description when it is considered in conjunction with the appended claims and the accompanying drawings.

DETAILED DESCRIPTION OF THE INVENTION

Figure 1:
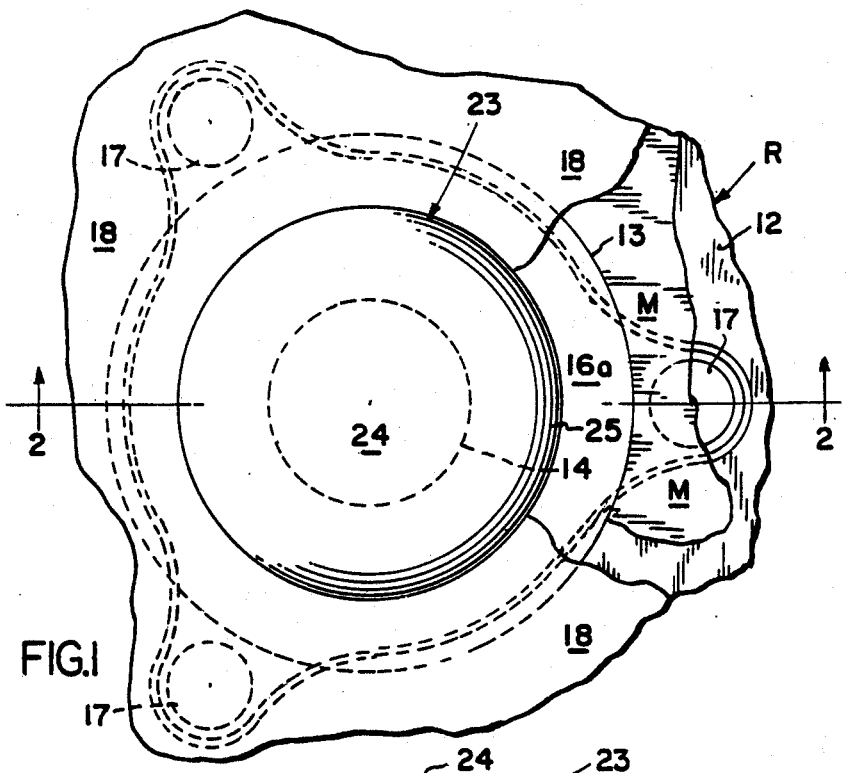
FIG. 1 is a top plan view of the vent structure.

Referring now more particularly to the accompanying drawings, and in the first instance to FIG. 1, the roof, generally designated R, which is disclosed, may typically consist of an interior metal building deck 10, supported on roof purlins 10*a*, which form the upper roof-supporting surface of a typical commercial building's frame structure. Typically, a near impermeable vapor barrier sheet 11, covers the surface 10 which, of course, also could be wood decking, and rigid fibrous or foam insulation boards or blocks 12 are provided between the barrier sheet 11 and the outer roof covering membrane, generally designated M. Membrane M has an opening 13 cut in it, to receive the novel vent structure, generally designated V, and it is to be understood a number of such breather vents V will be used in appropriately spaced apart relation on a typical roof R. As FIG. 2 particularly indicates, the insulation board 12 also has a circular opening 14 cut in it, which typically is filled with a loose fibrous insulation material 15 to facilitate air flow movement in the direction indicated by the arrow x to the vent structure V and to provide a weep sink.

The vent structure V, is fabricated in two component parts and, as shown, these parts include an upwardly extending open-ended tube 16 formed at its lower end with a radially outwardly extending flange 16*a* having three downwardly directed dimples 17 providing a stable tripod support of the vent structure V on the insulation blocks 12 under membrane M. A skirt 18 of the same roof membrane material is heat-welded to the flange 16*a*, and it is the skirt 18 which is lap welded then to the membrane M radially outwardly of the flange 16*a*. Typically, the membrane skirt 18 is heat welded to the flange 16*a* at the factory. The membrane skirt 18 is heat welded to the membrane M at the time the vent structure V is installed in the roof.

Figure 2:
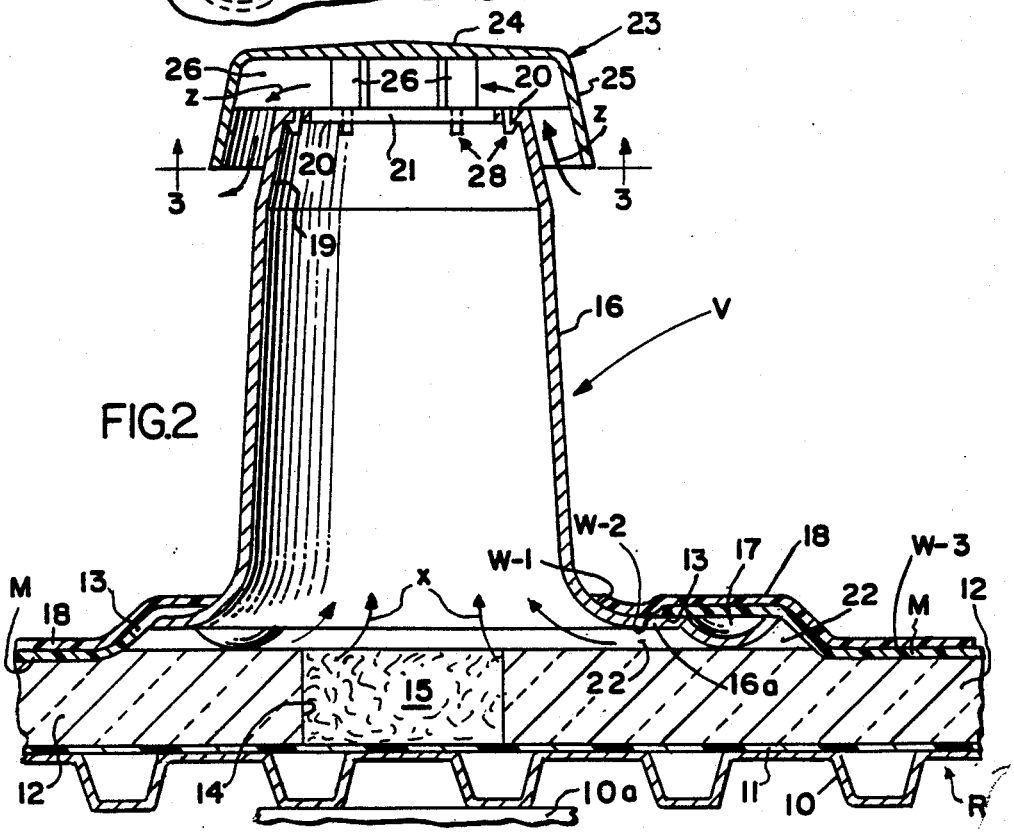
FIG. 2 is a sectional, elevational view showing the vent installed in a typical flat roof system, taken on the line 2—2 of FIG. 1.

As FIG. 2 indicates, the tube structure 16 has a convergently upwardly tapered peripheral wall portion 19, with an inturned flange 20, terminating to leave a sizeable top opening 21 in the upper end of tube 16. The lower end of tube 16 is open to the space 22, provided above the insulation blocks 12, by positioning dimples 17.

A cap or hood, generally designated 23, is provided for the upper end of the tube or stack 16 to prevent the entry of rain, snow and the like, and comprises a top wall 24 spaced above the inturned flange 20, which has a downwardly divergent peripheral wall 25 extending generally parallel to wall portion 19 to a distance overhanging about half of wall 19.

Integrally provided in the hood or cap 23 are uniformly spaced, vertically extending radial fins 26 which, when the cap 23 is in installed position, extend somewhat inwardly of flange 20. The fins 26, as FIG. 2 indicates, are integrated with the walls 24 and 25 to rigidify them, and have two additional functions. They function to vertically space the hood 23 from the flange 20, and are, as will later be described, also mechanisms for enhancing the moisture-removing function of the vent.

Figure 3:
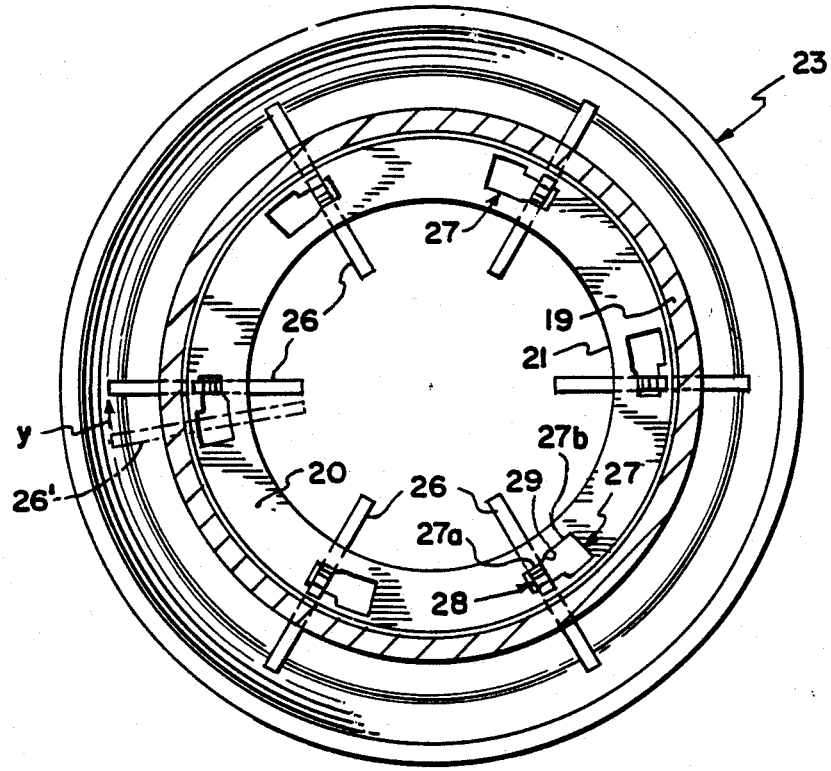
FIG. 3 is a transverse, sectional view, taken on the line 3—3 of FIG. 2.
Figure 4:
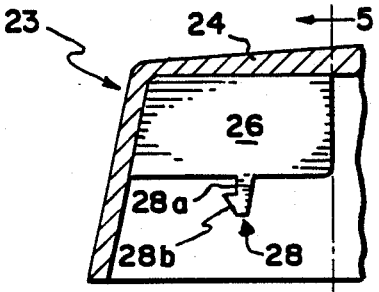
FIG. 4 is an enlarged, fragmentary, sectional, view of a portion of the hood or cap used on the vent, illustrating the dependent lock arms which are employed to releasably lock the cap in assembled position.
Figure 5:
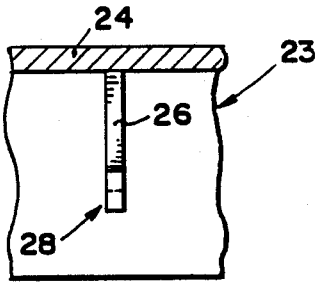
FIG. 5 is a fragmentary, sectional elevational view, taken on the line 5—5 of FIG. 4.
Figure 6:
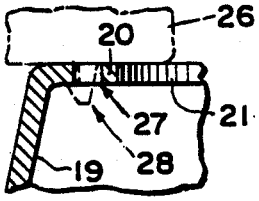
FIG. 6 is an enlarged, fragmentary sectional, elevational view of a portion of the upper end of the vent tube, with the hood parts being fragmentarily shown in chain lines.
Figure 7:
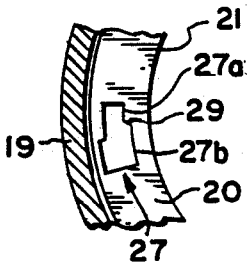
FIG. 7 is an enlarged, fragmentary, top plan view of a portion of the upper end of the stack tube.

As FIGS. 3 and 7 indicate, a series of bayonet-type slots 27 are provided at uniformly spaced circumferential intervals in the flange 20, and have reduced width portions 27*a* and expanded width portions 27*b*. Dependent from each of the fins 26, is an integrally formed lock leg 28, including a shank portion 28*a* and an enlarged hook portion 28*b*, which is adapted to initially pass downwardly through the expanded portion 27*b* of an opening 27. As indicated by the chain line position 26' of one of the fins 26 in FIG. 3, upon rotation of the duct or cap 23 in a clockwise direction, as indicated by the arrow y, the shank portion 28*a* is received within the reduced size portion 27*a* of slot 27, and the enlarged end 28*b* engages under the flange 20 in the manner indicated in FIG. 6 in chain lines. Pilot surface 29 deflects the shank portion 28*a* radially outwardly at the time of entry into the reduced size portion 27*a* to cause the hook 28 to be tightly held in slot portion 27*a* under tension. Each of the fins 26 is provided with a dependent lock leg 28, and the cap is rigidly locked in position by the legs 28 when the duct or cap 23 is rotated in a clockwise direction to the position indicated in FIG. 3, and can only, with the imposition of considerable manually exerted torque, be rotated reversely to unlock the cap.

THE OPERATION

In operation, at a proper location for installation of a vent structure V, an opening 13 is cut in membrane M. An opening 14 of smaller dimension is then cut in insulation board 12, and filled with a loose fibrous insulation material which provides a wicking effect. The opening 14 may aptly be termed a weep sink or weep hole which promotes diffusion of water vapor through the insulation. With the skirt 18 in lifted position, the vent structure V is vertically tilted and moved in a direction to slide the forward dimple or dimples 17 under the membrane M and then slid reversely to a position in which all the dimples 17 are supported on the insulation board surface 12 surrounding opening 14, as shown in FIG. 2. The skirt 18, which is welded to the flange 16*a* only at its inner annular edge from, typically, location W-1 to location W-2, is then released to overlap membrane M and is heat welded to the membrane M at location W-3.

On a windy day, an air stream traveling up between the walls 19 and 25 is converged by the fins 26, such that its velocity is increased, and a venturi suction is created tending to pull an air current upwardly out of the tubes 16. The air pulled upwardly out of tube 16 is a moist, rather than dry, air, if moisture is present in the space 22 and/or the weep sink 14, and this air is then moved outwardly.

The wind stream, whose velocity is increased by the fins 26, travels rapidly across the top of the stack 16 without any appreciable loss of velocity to the radially opposite fins 26, and downwardly between the walls 19 and 25, as indicated by the arrows z in FIG. 2. Because the fins 26 project radially inwardly of flange 20 approximately only a third of the distance to the center of stack 16, they are able to provide the convergent effect necessary, without cross-blocking air currents entering at the same time from between neighboring fins.

When no wind is blowing, the vent structure V is in a state of equilibrium, except in the wintertime when the interior of the building is being heated and there is some transfer of heat by the insulation which creates a stack effect and aids the drying process.

In the summertime, because the membrane M typically is white in color, the insulation 12 does not operate as a heat sink, and vent structures V remain in a state of equilibrium.

While one embodiment of the invention has been described in detail, it will be apparent to those skilled in the art that the disclosed embodiment may be modified. Therefore, the foregoing description in all aspects is to be considered exemplary rather than limiting in any way, and the true scope of the invention is that defined in the following claims.

What is claimed is:

1. In a plastic roof vent structure for use with heat weldable, impermeable plastic membrane roofs covering an underlying surface:

a. an elongate, essentially hollow, imperforate, vertical tube having an air outflow opening in its upper end defined by a generally vertical marginal wall surface and a laterally projecting base flange to which membrane material may be heat welded surrounding an air inflow opening in its lower end;

b. means incorporated with said tube for permitting vapor flow into the interior of said tube from under the membrane material;

c. an inversely positioned, imperforate, cup-shaped tube hood having a side wall and a top wall, the top wall being spaced upwardly from the top of the tube to form a lateral space above and communicating with the interior of the tube; and d. generally horizontally projecting and radially extending, circumferentially spaced, vertical, venturi passage-creating fins in said lateral space extending radially inwardly to project substantially inwardly beyond said marginal wall surface while terminating short of the center of said tube, said fins being spaced circumferentially to define passageways between them which converge radially inwardly directly above said outflow opening and enhance the pull of moisture-laden air from said tube on windy days.

2. The structure defined in claim 1 wherein said base flange has a series of circumferentially spaced vertical protrusion tripod knobs molded therein to project downwardly and support the base flange in a manner to provide a vapor flow passage between the base and underlying surface.

3. The structure defined in claim 1 wherein the fins are integrated with the top wall and side wall of the hood and rest on the top of the tube to space the top wall of the hood above the tube.

4. The structure defined in claim 3 wherein the upper end of the tube has a radially inturned horizontal flange on which said fins rest.

5. The structure defined in claim 4 wherein the side wall of the hood projects downwardly to provide a downwardly directed passage between the side wall and tube, and said fins bridge said downwardly directed passage and extend radially inwardly from the side wall of the hood to terminate at a predetermined distance radially inwardly of said horizontal flange in the neighborhood of one-third the distance to the center of the tube.

6. The structure defined in claim 1 wherein said side wall of the hood is flared outwardly and downwardly and the upper portion of the tube opposite said flared side wall of the hood is inclined upwardly and radially inwardly.

7. The structure of claim 1 wherein protrusion hook and socket lock means is provided on said fins and tube to disengageably lock the hood to the tube.

8. A plastic roof vent structure for use with heat weldable, impermeable plastic membrane roofs covering an underlying surface comprising:

a. an elongate, essentially hollow, imperforate, vertical tube having a laterally projecting base flange to which membrane material may be heat welded;

b. means incorporated with said tube for permitting vapor flow into the interior of said tube from under the membrane material;

c. an inversely positioned, imperforate, cup-shaped tube hood having a side wall and a top wall, the top wall being spaced upwardly from the top of the tube to form a lateral space above and communicating with the interior of the tube;

d. generally radially extending, vertical, venturi passage-creating fins in said lateral space spaced circumferentially to define passageways between them which converge inwardly and enhance the pull of moisture-laden air from said tube on windy days, and e. protrusion hook and socket lock means provided on said fins and tube to disengageably lock the hood to the tube;

f. said protrusion and socket lock means including integral dependent hooks on said fins and circumferentially extending bayonet sockets for receiving said hooks in said tube, said hooks being adapted to be moved to and from locked position by relative rotary movement of the hood and tube.

9. The structure of claim 8 wherein the upper end of said tube has a radially inturned horizontal flange provided with slot-like openings forming said sockets at circumferential intervals to pass the hooks downwardly beneath the flange.

10. The structure of claim 9 wherein said hooks depend from reduced dimension shanks and said openings have a portion of greater radial width to vertically pass said hooks and a circumferentially communicating portion of reduced radial width which will pass said shanks but will not pass said hooks.

11. The structure of claim 10 wherein a radially inclined pilot surface connecting said portions of greater and reduced radial width deflects said shanks radially, the shanks thereby being tensioned to lock in the opening portions of reduced radial width and returning to original position only when disposed once again in the opening portions of greater radial width.

12. In a weldable, impermeable plastic membrane roof structure covering an underlying surface:

a. a thermoplastic plastic membrane having an opening provided therein;

b. an elongate, essentially hollow, imperforate, vertical tube, open at its upper and lower ends and projecting upwardly through said opening, and having a laterally projecting thermoplastic base flange to which membrane material may be heat welded;

c. downwardly projecting, circumferentially spaced, tripod, perimetral, knob protrusions on said flange incorporated with said tube for supporting said tube on said underlying surface beneath said membrane and permitting radial vapor flow into the interior of said tube from under the membrane material;

d. an inversely positioned, imperforate, cup-shape tube hood having a side wall and a top wall, the top wall being spaced upwardly from the top of the tube to form a lateral space above and communicating with the interior of the tube; and e. generally radially extending, vertical, venturi passage-creating fins in said lateral space spaced circumferentially to define passageways between them which converge radially inwardly directly above and in vertical alignment with said upper end opening and enhance the pull of moisture-laden air from said tube on windy days.

13. In a weldable, impermeable, plastic membrane roof structure covering an underlying surface;

a. a thermoplastic plastic membrane having an opening provided therein;

b. an elongate, imperforate vertical tube projecting upwardly through said opening, and having a base flange, projecting laterally beneath and beyond said opening, to which membrane material may be heat welded;

c. downwardly projecting, circumferentially spaced, tripod, perimetral, protrusion knobs on said flange underlying said membrane for supporting said tube on the underlying surface, and providing radial spaces beneath the membrane for permitting vapor flow into the interior of the tube;

d. an imperforate cap for said tube having a top wall spaced above the open upper end of the tube, and a side wall, and e. a membrane skirt heat welded to said base flange inwardly of the opening in said membrane and heat welded to said membrane laterally outwardly of the base flange.

14. The structure defined in claim 13 wherein venturi passage-creating means is incorporated to enhance the pull of moisture-laden air from the upper end of said tube on windy days.

15. In a roof vent structure for use with a heat weldable, impermeable plastic membrane roof covering an underlying surface;

a. an elongate, essentially hollow, imperforate, vertical tube having an air outflow opening at its upper end and an air inflow opening at its lower end;

b. means for supporting the lower end of said tube within an opening cut in said membrane;

c. means incorporated with said tube for permitting vapor flow into the interior of said tube from under the membrane material;

d. a cap for said tube having a side wall and a top wall, the top wall being spaced upwardly from the top of said tube to form a lateral space above and communicating with the interior of the tube; and e. circumferentially spaced fin means, incorporated with said vent structure in said lateral space, creating circumferentially segregated horizontally extending venturi passages in vertical alignment with said air outflow and inflow openings to enhance the pull of moisture-laden air from said tube on windy days.

* * * * *